US005148616A

United States Patent [19]

Maguina-Larco

[11] Patent Number: 5,148,616

[45] Date of Patent: Sep. 22, 1992

[54] ADAPTOR FOR EARTH WORKING CUTTING TEETH AND HOLDING CLAMP

[75] Inventor: Alfredo Maguina-Larco, Lima, Peru

[73] Assignee: A.M. Logistics Corporation, Woodbridge, Va.

[21] Appl. No.: 629,814

[22] Filed: Dec. 21, 1990

[51] Int. Cl.[5] ..... E02F 9/28

[52] U.S. Cl. ..... 37/141 T; 37/142 R; 299/91

[58] Field of Search ..... 37/142 A, 142 R, 141 T, 37/141 R; 299/91, 92, 93

[56] References Cited

U.S. PATENT DOCUMENTS

| | | | |
|---|---|---|---|
| 2,729,902 | 1/1956 | Launder | 37/142 R |
| 3,496,657 | 2/1970 | Sturgeon | 37/142 A |
| 3,678,605 | 7/1972 | Prime | 37/141 T |
| 4,187,035 | 2/1980 | Colburn | 37/142 A X |
| 4,282,665 | 8/1981 | Fletcher et al. | 37/142 A |
| 4,343,516 | 8/1982 | Aden | 299/91 X |
| 4,712,321 | 12/1987 | Berchem et al. | 37/142 R |
| 4,899,830 | 2/1990 | Maguina-Larco | 37/142 R X |
| 5,027,535 | 7/1991 | Maguina-Larco | 37/141 T |

OTHER PUBLICATIONS

Kennametal, Checking Cutter Bits, Bit Holders and Flighting, date unknown.

*Primary Examiner*—Dennis L. Taylor
*Assistant Examiner*—J. Russell McBee
*Attorney, Agent, or Firm*—Cushman, Darby & Cushman

[57] ABSTRACT

An adaptor enables conventional earth working machinery to use boltless holding clamps for cutting teeth made from bar stock material. One end of the adapter has a shank engagement end which couples a digging or cutting member of the machine while the other receiving end is adapted to receive the boltless holding clamp and the cutting tooth in wedge-tightened clamping engagement. The shank engagement end may employ bolts, dowels, pins or may be welded to the digging or cutting member, e.g., a bucket, blade, scarifier shank, shovel, etc. The clamp receiving end has wedge-locking grooves which interlock with complementary locking flanges of the clamp and a flat bearing surface which frictionally bears against the cutting tooth when clamped. Frictional properties at the interface between the adaptor bearing surface and the tooth differ from frictional properties at the clamp-to-tooth interface in a manner to provide self-tightening in response to axial impact loads on the tooth. The adaptor also includes clamp guards to prevent loosening of the clamp during back-up movements.

8 Claims, 3 Drawing Sheets

ADAPTOR FOR EARTH WORKING CUTTING TEETH AND HOLDING CLAMP

CROSS-REFERENCE TO RELATED PATENTS AND APPLICATIONS

This invention is related to the subject matter of commonly-owned U.S. Pat. 4,899,830 titled "Cutting Tooth Assembly For Earth Working Machines" issued Feb. 13, 1990 to the same inventor hereof, which is incorporated herein by reference.

This invention is also related to commonly-owned allowed U.S. Pat. No. 5,027,535 filed Oct. 9, 1990 titled "Boltless Holding Clamp For Earth Working Cutting Teeth" by the same inventor hereof, which is also incorporated herein by reference.

This invention is also related to commonly-owned U.S. Pat. Application Ser. No. 07/633,515 filed Dec. 31, 1990 titled "Holding Clamp And Reversible Earth Working Cutting Teeth" by the same inventor hereof.

FIELD OF THE INVENTION

This invention pertains to wedge clamping systems for securing replaceable cutting teeth to digging members of earth working equipment, such as an earth moving machine, an agricultural machine, mining equipment, or a machine generally used in the construction or mining industries. More particularly, the present invention relates to an adaptor which permits conventional earth moving equipment to utilize the novel holding clamp described in my copending patent applications and issued patent, mentioned above.

BACKGROUND OF THE INVENTION

An earth working machine typically utilizes a digging or cutting member which employs a plurality of shanks to which teeth are attached by a variety of means including welding, bolting, and wedge-fitting. It has been recognized that holding clamps for holding teeth to shanks provide certain advantages over current boltless teeth, as shown, for example, by U.S. Pat. 2,222,071 issued to Gustafson. This advantage stems from different conflicting physical requirements of the cutting teeth and the holding mechanism. The cutting point of the tooth must be formed of a hard wear-resistant material while the holding mechanism usually requires a material of at least some elasticity and/or ductility. However, many digging members cannot take advantage of boltless clamping systems because either they have no wedge-locking system in place or they have non-standard locking grooves which are not adapted to fit the boltless holding clamp.

As widely practiced in the art, the tooth may connect to a shank by a wedging force between a groove in the shank and a boltless tooth which includes at one end thereof, a receiving channel that is wedged upon a shank. Such an arrangement permits quick hammer-driven changing of worn teeth but suffers the disadvantage of being expensive due the conflicting physical requirements of the cutting point of the tooth and its receiving channel. The cutting point must be hard and rigid for good wear resistance while the receiving channel must be somewhat resilient to be wedged upon the shank.

It is highly desireable to provide a boltless holding clamp, rather than a boltless tooth, wherein the clamp is adapted for use with an "adjustable" cutting tooth whereby a worn tip or cutting point thereof might be quickly extended and re-fastened to the shank of the digging member. By adjustable, it is meant that the tooth may be loosened in the holding assembly, axially extended forward of the digging member of the earth working machine, and then refastened to the shank by the holding clamp. Provision of rapid adjustment provides substantial economic benefits in reduced machine down time and reduced teeth replacement costs since a substantial portion of the expensive tooth material may be consumed, rather than discarded.

In view of the foregoing, the present invention has as its primary objective the purpose of permitting utilization by conventional earth working equipment of a boltless holding clamp which may be frictionally engaged upon a shank thereby to enable quick changing and adjustment of a cutting tooth of hardened bar stock material.

As stated in my above-referenced copending applications, utilization of a holding clamp advantageously permits, among other things, the use of bar stock material of constant cross section to form a cutting tooth of a hard wear-resistant material, positional adjustment of the clamped position of the cutting tooth on a shank of an earth working, digging or cutting member, absorption of vibrational loosening forces acting on the tooth, self-tightening of the tooth against the shank in response to impact loads applied to the tooth during digging and/or cutting operations.

SUMMARY OF THE INVENTION

In accordance with the present invention, an adaptor for enabling use of a boltless holding clamp for an earth working cutting tooth of constant transverse cross section comprises an shank engagement end for connecting to the digging member of an earth working machine and a clamp receiving end for receiving a boltless holding clamp. The clamp receiving end includes a bearing surface on one side thereof for frictionally engaging a cutting tooth and a pair of locking grooves on the other side thereof for wedgedly engaging complementary locking grooves in the boltless holding clamp. When assembled, the clamp is adapted to force the cutting tooth against the adaptor bearing surface thereby to hold the tooth in self-tightening clamping engagement.

The shank engagement end of the adaptor may include bolts, dowels, pins, another wedge-locking groove system, or the shank engagement end may simply be welded to the digging member. The clamp receiving end of the adaptor accommodates the boltless holding clamp which is axially positioned thereover, in its preferred form. The adaptor bearing surface defines one boundary of the tooth receiving channel which is of constant transverse cross section complementary to the constant transverse cross section of the tooth. Other boundaries of the tooth receiving channel are defined by internal surfaces of the boltless holding clamp.

Other aspects, features and advantages of the present invention will become more readily apparent upon review of the following description taken in connection with the accompanying drawings, all of which form part of this specification, wherein like reference numerals designate corresponding parts in the various Figures.

DESCRIPTION OF ILLUSTRATIVE EMBODIMENTS

Figure 1:
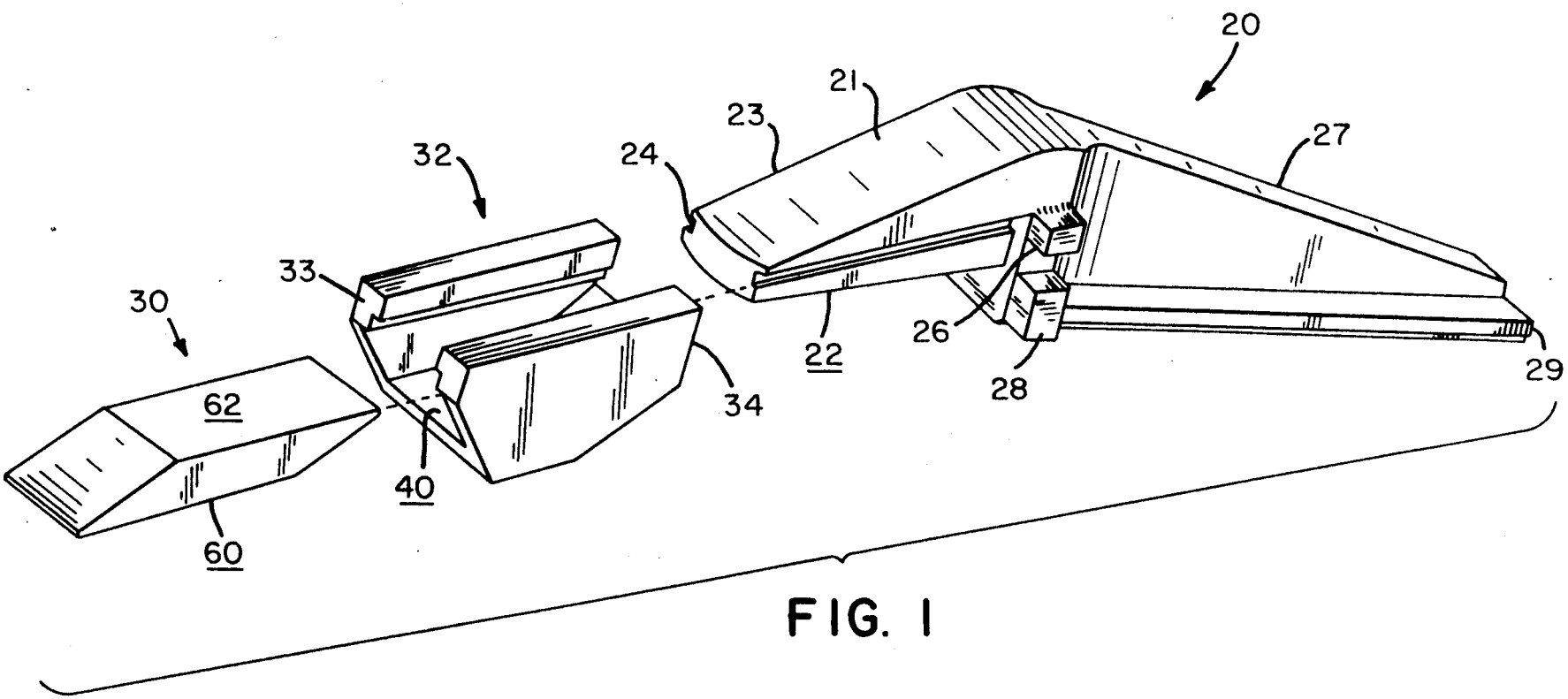
FIG. 1 is a spaced-apart an exploded view of a cutting tooth, a holding clamp and an exemplary adaptor according to the present invention.
Figure 2:
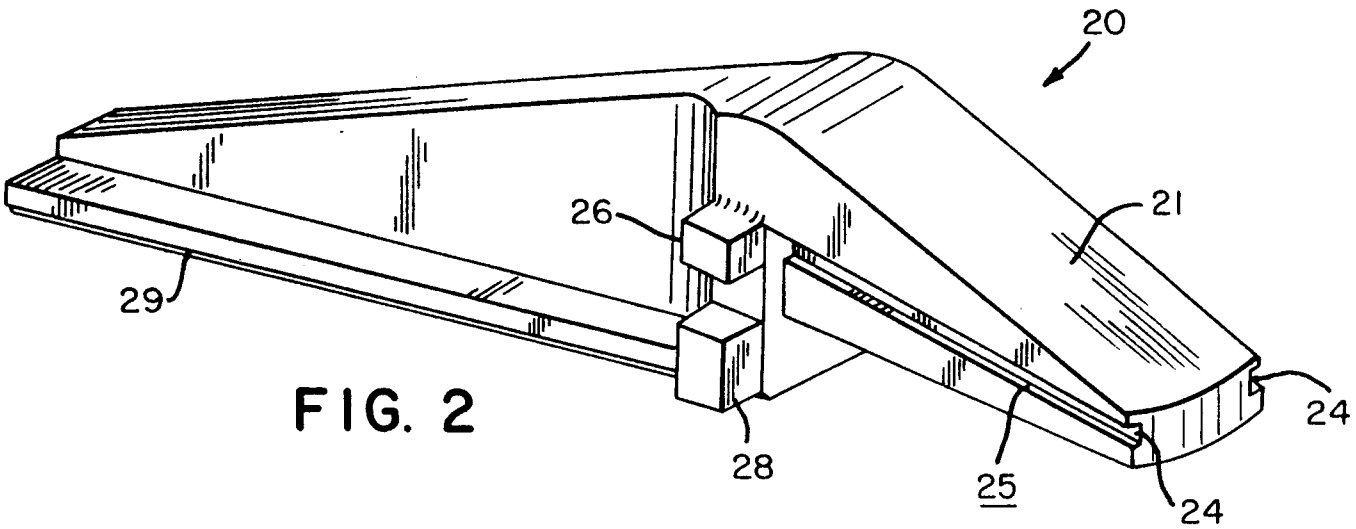
FIG. 2 is a perspective view of an adaptor according to the present invention.
Figure 3:
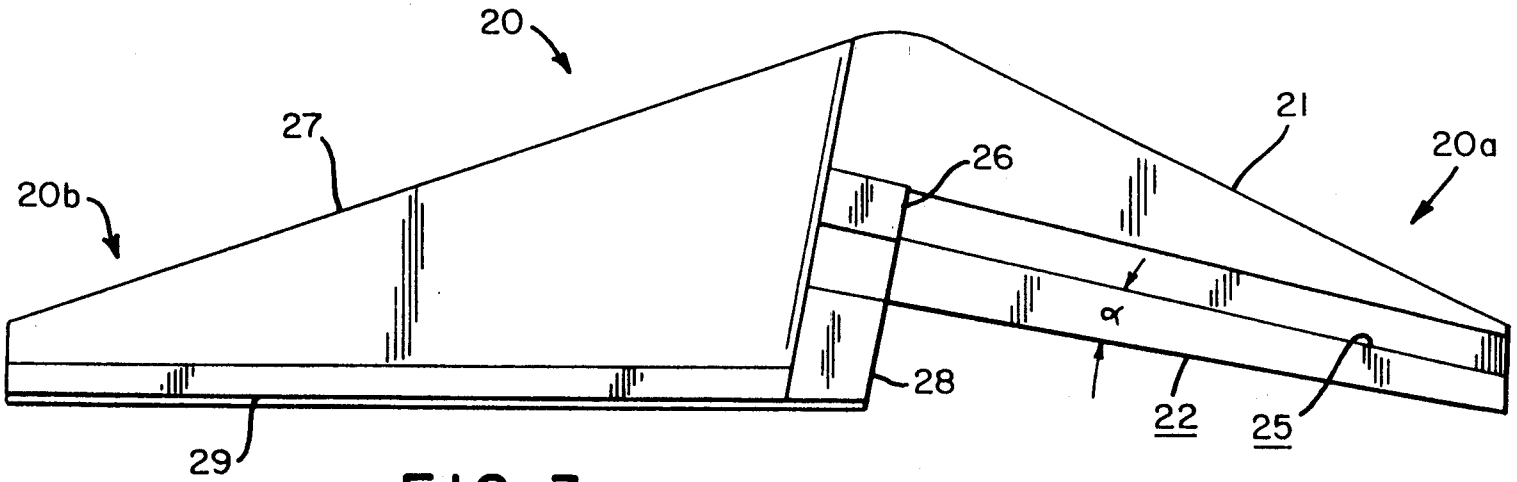
FIGS. 3 is a side view of the adaptor depicted in FIG. 2.

FIG. 1 herein depicts an exploded view of an adaptor 20 in the form of a shank, a U-shaped holding clamp 32 and a cutting tooth 30. The adaptor 20, more particularly shown in FIGS. 2 and 3, is formed of a very hard steel and includes a wide flange 29 which is connected to a digging or cutting member of the earth working machine (not shown here, but shown in my incorporated U.S Pat. 4,899,830) by dowels, welding, bolting or by other convenient means, as is conventional in the art. The adaptor 20 has a shank engagement end 20*a* which is adapted to couple the shank of an earth working machine, e.g., to the digging or cutting member, and a clamp receiving end 20*b* which slideably engages the inventive boltless holding clamp described in my allowed U.S. Pat. Application Ser. No. 594,545, mentioned above. The adaptor 20 also includes clamp guards 26 and 28 connected to each side thereof. These clamp guards protect the holding clamp for loosening during back-up movements of the digging member by pushing away earth material from the path of the holding clamp thus preventing reverse strikes on the rear of the clamp.

In addition, the adaptor 20 is formed with a steel web 27 for supporting both the flange 29 and the snout 21. As noted, in accordance with one aspect of the invention, the thickness of the steel web 27 is less than the width of the snout and the tooth in order to reduce contact wear with the soil. The wider tooth, clamp and/or snout cut swaths for the web 27 thus increasing its longevity.

Figure 4:
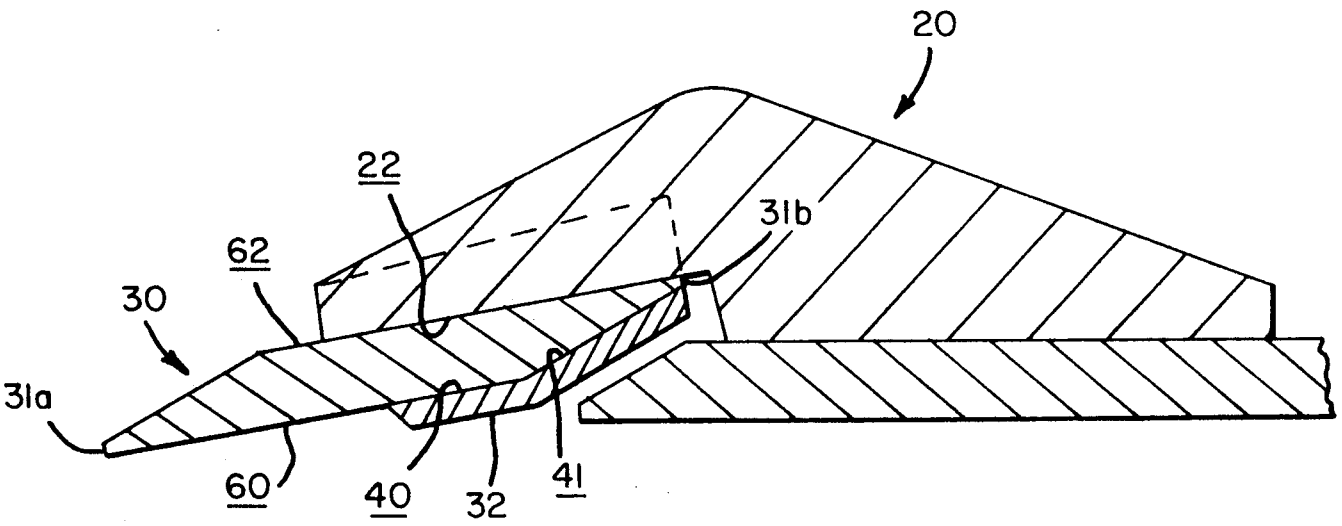
FIG. 4 is a cross-sectional view of the inventive adaptor, a cutting tooth and a holding clamp shown in assembled relation.

The adaptor 20 carries a planar surface 22 on the snout 21, a pair of locking grooves 24 on each side of the shank, and a pair of inclined wedge-locking bearing surfaces 25 facing inwardly of the grooves 24. Planar surface 22 on the adaptor provides a bearing surface parallel to a z-axis against which an upper surface 62 of the cutting tooth 30 bears when in frictional contact, as depicted in FIG. 4. When the tooth is clamped upon the adaptor by the holding clamp, the overall interface friction at bearing surface 22 and tooth surface 62 is less than the interface friction between the tooth and clamp surfaces 60 and 40. This differential friction enables self-tightening of the clamp against the tooth and adaptor in response to axial loads encountered by the tooth. Assuming the frictional properties of the hard, wear-resistant tooth is preset, differential friction between the adaptor-to-tooth and the clamp-to-tooth interfaces may be attained by lessening the coefficient of friction on surface 22, increasing the friction on surface 40, or both.

The respective bearing surfaces 25 in the snout grooves 24 diverge from the surface of planar face 22 from the open end of the grooves, at a small angle $\alpha$ of, for example, 4°, more or less, as shown in FIG. 3. The angle $\alpha$ of divergence defines excursions of clamping force along the y-axis for given movements of a U-shaped clamp 32 along the z-axis. To attain more desireable force excursions in relation to clamp movement, the invention advantageously provides a holding clamp 32 being formed of a material having either or both a special structural configuration or a predetermined stress-strain characteristic, e.g., ductility and/or modulus of elasticity. Further, planar surface 22 and the bearing surfaces 25 of locking grooves 24 are smooth surfaces providing for a relatively low friction coefficient.

The U-shaped holding clamp 32 has a front end 33 which receives the tooth 30 in a first receiving channel of the clamp, and a rear end 34 which is adapted to be positioned upon the snount 21 via a second receiving channel in the clamp. The first receiving channel guides the tooth during assembly and holds it when frictionally clampled. The receiving channel for receiving the tooth is defined by a cmapling surface 40 of the clamp which bears against a surface 60 of the tooth, respective side surfaces of the clamp which slideably engage respective sides of the tooth 30, and guide surfaces of the clamp which slideably engage respective portions of surface 62 of the tooth during assembly or positional adjustment. The receiving channel for the tooth is generally rectangular, also being of constant transverse cross section complementary to the constant transverse cross section of the tooth 30.

When place in clamping engagement, little or no contact is made between tooth surface 62 and the pair of clamp guide surfaces which run internally of the holding clamp 32 since frictional contact is developed and maintained between mating clamp-tooth surface pairs 40–60 and mating adaptor-tooth surface pairs 22–62.

An optional inclined rearward surface 41 in the first receiving channel of the clamp provides an abutment that defines the rearward positional limit of the tooth 30 relative to the clamp 32 when inserted into the receiving channel. However, the tooth need not be fully inserted, but may be adjustably held at various axial positions along the adaptor surface 22, as explained in my co-pending, incorporated patent applications mentioned above. The abutment surface 41 is inclined to accommodate the inclined cutting points of the tooth near its respective cutting edges 31*a* and 3l*b* (FIG. 4). Alternatively, that optional abutment surface may be located on the adaptor, rather than in the receiving channel of the holding clamp. In either case, the abutment preferably conforms with the shape of the cutting point of the teeth, however formed. Preferably, both the cutting point of the tooth and the abutment are beveled.

While various embodiments of the invention have been described in accordance with what is presently conceived to be the most practical and preferred embodiment, it is to be understood that the invention is not to be limited to the disclosed embodiment, but on the contrary, is intended to cover various modifications and equivalent arrangements included within the spirit and the scope of the appended claims, which scope is to be accorded the broadest interpretation of such claims so as to encompass all such equivalent structures. For example, the shank engagement end of the adaptor may take on a variety of forms, the objective being to provide means for connecting to the digging or cutting member of an earth working machine. The adaptor may also be formed, integrally or otherwise, directly with blades, buckets, shovels, diggers, cutters and the like. Although metal is commonly used for the adaptor material, my invention is not limited thereto, but is intended to embrace other suitable materials. Accordingly, it is my intent to include all such modifications and adaptations as may come to those skilled in the art.

What is desired to be secured by United States Letters Patent is:

1. An adaptor for connecting a boltless holding clamp, a cutting tooth formed from a hard material having constant transverse cross section, and a digging member of an earth working machine wherein said clamp comprises a substantially U-shaped body of material having appending wedge-locking flanges, said U-shaped body partially defining an elongated receiving channel means for receiving said cutting tooth, said adaptor comprising:

shank engagement means located at one end thereof for connecting with said digging member, and clamp receiving end means located at the other end thereof for receiving said clamp and tooth in clamping engagement, said receiving end means further including bearing surface means for cooperating with said U-shaped body to define a completed receiving channel means of constant transverse cross section which bears against said tooth when in clamping engagement, said receiving end means further including locking grooves coextensive with said receiving channel means for wedgedly interlocking with said appending flanges of said holding clamp, whereby said appending flanges, locking grooves and completed receiving channel means provides means for self-tightening said tooth of constant transverse cross section within said completed receiving channel means also of constant cross section in response to axial forces applied to said tooth and whereby said cutting tooth may be clamped at adjustable positions along said bearing surface.

2. An adaptor as recited in claim 1 further including clamp guard means for protecting said holding clamp against loosening due to reverse impacts produced during unloading operations.

3. An adaptor as recited in claim 1 wherein said receiving end means is wider than said shank engagement means whereby to lessen direct contact between the shank engagement means and the earth during digging or cutting operations.

4. An adaptor as recited in claim 1 including means for developing a first frictional contact force between said cutting tooth and said adaptor bearing surface and a second frictional contact force between said tooth and holding clamp, said first force being less than said second force.

5. An adaptor as recited in claim 1 having a first area of surface contact between said cutting tooth and said adaptor bearing surface and a second area of surface contact between said tooth and said holding clamp, said first area being less than said second area.

6. A digging member of an earth working machine including the adaptor as recited in claim 1.

7. The invention as recited in claim 1 wherein said wedge-locking flanges of said clamp include first wedge bearing surface means inclined at an angle $\alpha$ from said adaptor bearing surface (22) and wherein the locking grooves (24) of the adaptor include second wedge bearing surface means (25) which is also inclined at substantially the same angle $\alpha$ from said adaptor bearing surface (22).

8. In combination, a boltless holding clamp for a cutting tooth for use with an earth working machine wherein said boltless holding clamp includes a U-shaped body of material having appending wedge-locking flanges and a receiving channel means for partially defining a channel of constant transverse cross section which receives a cutting tooth also having a constant transverse cross section, an adaptor for interconnecting said boltless holding clamp and tooth to a digging member of said earth working machine wherein said adaptor comprises shank engagement means located at one end of said adaptor for coupling said digging member, and clamp receiving end means located at an opposing end of said adaptor for receiving said boltless holding clamp, said receiving end means including bearing surface means for cooperating with said U-shaped body to define a completed receiving channel means of constant transverse cross section which bears against said tooth when in clamping engagement, said receiving end means further including locking grooves coextensive with said completed receiving channel means for wedgedly interlocking with said appending flanges of said holding clamp, wherein said appending flanges, locking grooves and completed receiving channel means provide means for self-tightening said tooth of constant transverse cross section within said completed receiving channel means also of constant cross section in response to axial forces applied to said tooth and, whereby said cutting tooth may be clamped at adjustable positions along said bearing surface.

* * * * *